US009119764B2

(12) United States Patent
Favreau et al.

(10) Patent No.: US 9,119,764 B2
(45) Date of Patent: Sep. 1, 2015

(54) BEAD MASSAGE DEVICE WITH A ROTARY VESSEL

(75) Inventors: Thierry Favreau, Noirmouties en L'ile (FR); Gérard Flavien, La Roche sur Yon (FR); Daniel Bussolino, La Planche (FR)

(73) Assignee: Aquaroll, Noirmoutler en L'ile (FR)

( * ) Notice: Subject to any disclaimer, the term of this patent is extended or adjusted under 35 U.S.C. 154(b) by 992 days.

(21) Appl. No.: 13/255,792

(22) PCT Filed: Feb. 1, 2010

(86) PCT No.: PCT/EP2010/051189

§ 371 (c)(1), (2), (4) Date: Nov. 3, 2011

(87) PCT Pub. No.: WO2010/102860

PCT Pub. Date: Sep. 16, 2010

(65) Prior Publication Data

US 2012/0041349 A1 Feb. 16, 2012

(30) Foreign Application Priority Data

Mar. 10, 2009 (FR) ..... 09 01085

(51) Int. Cl.
*A61H 7/00* (2006.01)
*A61H 15/00* (2006.01)

(52) U.S. Cl.
CPC .... *A61H 15/0078* (2013.01); *A61H 2015/0064* (2013.01); *A61H 2205/065* (2013.01)

(58) Field of Classification Search
CPC . A61H 15/00; A61H 15/0078; A61H 35/002; A61H 2007/009; A61H 2015/00; A61H 2015/0042; A61H 2015/0064; A61H 2201/16; A61H 2201/35; A61H 2201/164; A61H 2205/065; A61H 2205/104
See application file for complete search history.

(56) References Cited

U.S. PATENT DOCUMENTS

| | | | | |
|---|---|---|---|---|
| 3,001,208 | A * | 9/1961 | Rosoff | 601/157 |
| 4,813,405 | A * | 3/1989 | Filip | 601/134 |
| 4,994,294 | A * | 2/1991 | Gould | 426/519 |
| 2009/0209891 | A1 * | 8/2009 | Gavriely et al. | 601/134 |

FOREIGN PATENT DOCUMENTS

EP 1419758 A1 5/2004

OTHER PUBLICATIONS

International Search Report dated Apr. 26, 2010 for corresponding International Application No. PCT/EP2010/051189, filed Feb. 1, 2010.

English Translation of the International Preliminary Report on Patentability and Written Opinion dated Oct. 4, 2011 for corresponding International Application No. PCT/EP2010/051189, filed Feb. 1, 2010.

* cited by examiner

*Primary Examiner* — Quang D Thanh
(74) *Attorney, Agent, or Firm* — David D. Brush; Westman, Champlin & Koehler, P.A.

(57) ABSTRACT

A bead massage device is provided, which includes a vessel for receiving a plurality of beads submerged in a bath. The vessel includes at least one inner wall that drives the beads so that the beads are moved when contacting a human limb inserted into said vessel. The vessel is rotatably mounted and preferably removable so that it can be easily cleaned and disinfected.

11 Claims, 2 Drawing Sheets

BEAD MASSAGE DEVICE WITH A ROTARY VESSEL

CROSS-REFERENCE TO RELATED APPLICATIONS

This application is a Section 371 National Stage Application of International Application No. PCT/EP2010/051189, filed Feb. 1, 2010 and published as WO 2010/102860 on Sep. 16, 2010, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the disclosure is that of the designing and manufacture of massage equipment. More specifically, the disclosure pertains to a bead massage device designed especially for massaging the lower and upper limbs of the human body or again for massaging feet and hands.

The disclosure finds particularly advantageous application especially in the actions of:

- rehabilitating or bringing relief to the upper limbs (hands, wrists and elbows) and lower limbs (feet, ankles) affected especially by trauma, sprains, rheumatism, arthritis, algodystrophy, Dupuytren's disease, edema, post-operative conditions, neurological disorders, etc;
- relaxing, relieving and loosening the above-mentioned limbs;
- activating blood micro-circulation especially for diabetic patients.

BACKGROUND OF THE DISCLOSURE

In the field of the disclosure there is, among other devices, a bead massage device described in the patent document published under number FR-2 847 159.

The bead massage device described in this document comprises a vessel in which a large quantity of beads is placed, submerged in a bath, the beads being put into motion by an endless conveyor belt in such a way that the beads are rotationally carried along by the belt and the beads shift in contact with a limb, of which the part to be massaged is submerged in the beads.

The conveyor belt is driven by a roller which also tensions the belt, the upper part of the belt being held in an incurvated position at the bottom of the vessel by means of guides fixed to lateral flanges.

The principle of a massage device of this kind gives highly satisfactory results in terms of massaging.

However, this device has several drawbacks in terms of manufacture, maintenance, cleaning and disinfection.

Indeed, in practice, the guiding and tensioning of the conveyor belt calls for fairly lengthy and painstaking operations. These operations must be performed during the initial assembly of the device in the workshop. These operations therefore tend to take up manpower time which has an impact on the sale price of the device, and this is of course not desirable.

These operations must also be performed during maintenance work on the device. It is necessary to regularly renew the bath in which the beads are submerged, clean the beads themselves (human skin residues may lie in the vessel even after it has been drained) and even disinfect/decontaminate the vessel.

The prior art device referred to here above provides for a system for the circulation and filtering of the aqueous solution in order to filter and remove human tissues, such as dry skin, from the solution.

A lateral hatch is also provided in this device for removing the beads after the vessel of the device has been drained in order to enable the renewal of the beads.

In practice, the vessel needs to be dismounted from the device to extract so that they can be either cleaned and disinfected or replaces or so that the vessel itself can be cleaned/disinfected.

Now, to dismount the vessel, it is necessary to also separate the conveyor belt from its driving, guiding and tensioning system. These dismounting operations are relatively lengthy and complex.

Naturally, the re-mounting of the set and especially the tensioning of the conveyor belt also entails difficulties.

SUMMARY

An aspect of the disclosure relates to a bead massage device comprising a vessel designed to receive a plurality of beads submerged in a bath and means for driving said beads in such a way that the beads are moved by a motion in contact with a person's limb inserted into said vessel, characterized in that said driving means comprise at least one internal wall of the vessel against which said beads are designed to be in contact, said vessel being rotationally mounted.

Thus, through an embodiment of the invention, the mobility of the beads is obtained directly by the rotating vessel by means of its internal walls.

An embodiment of the invention therefore does away with the need to use an endless conveyor belt such as the one implemented in the prior art referred to here above.

An embodiment of the invention therefore provides for major gains in assembly time and therefore in manpower costs, especially by doing away with the adjustment and setting time needed for the efficient guidance and tensioning of the conveyor belt according to the prior art.

As shall be seen more clearly here below, a bead massage device according to an embodiment of the invention also provides advantages in the maintenance, upkeep, cleaning and/or disinfection of the device and of the beads that it contains.

According to an advantageous solution, the vessel is mounted so as to be rotationally mobile about an axis inclined between the vertical and the horizontal.

An embodiment of the invention thus provides for an optimized stifling of the beads present in the vessel, these beads being driven from a bottom part of the vessel towards a top part from which they drop from simple gravity. The peripheral beads of the vessel are thus directed to a central part of the vessel, and inversely, and this is done continuously, thus tending to increase the massaging effect of the beads on the limbs present in the vessel.

In this case, said vessel is mounted so as to be rotationally mobile about an inclined axis forming an angle of 5° to 85° with the vertical.

Advantageously, said internal walls have a series of relief features.

Thus, the capacity of the internal walls to drive the beads in an even and continuous motion is increased.

In this case, said relief feature are preferably constituted by evenly distributed ridges.

According to another advantageous characteristic of an embodiment of the invention, the device comprises means for draining said beads and/or said bath from the bottom of said vessel.

It is thus easy for the user to drain the vessel, by gravity, without its being necessary to dismount the vessel from the device.

Preferably, said draining means comprise a first drain plug for said bath and a second drain plug for the beads, provided with means to retain said beads in said vessel.

Thus, it is possible to drain the vessel in separating the bath and the beads, by first of all draining out the bath (the beads being retained in the vessel) and then draining out the beads.

According to an advantageous solution, said first and second plugs are mounted on a single drainpipe.

Thus, the design of the device as well as its use are simplified, in avoiding the use of two distinct drainpipes.

In this case, said second plug is preferably mounted directly on said drainpipe, said first plug being mounted indirectly on said pipe while being coupled to the second plug which has:

- a ring with an upper part comprising means for being mounted on said drainpipe,
- an extension of said ring at its lower part, having means for mounting said first plug;
- a screen for retaining said beads between said upper part and said extension.

Such a system proves to be particularly practical for use: initially, the user removes the first plug which is the first plug at the greatest distance from the vessel, enabling the draining of the bath contained in the vessel; in a second stage, the user removes the second plug which is still mounted in the drain pipe, thus enabling the extraction by gravity of the beads contained in the vessel.

According to yet another characteristic of an embodiment of the invention, said vessel is mounted removably on a frame bearing means for driving the vessel rotationally.

The user can thus also clean and disinfect the vessel in handling conditions that enable easy access into the interior of the vessel, as opposed to action taken within the vessel while it is still mounted on the frame.

It can be noted that this characteristic is especially advantageous since the dismounting and remounting of the vessel on the frame can be done speedily and easily because of the principle of an embodiment of the invention.

According to one particular embodiment, said vessel is mounted so as to be rotationally mobile on a frame which is itself mounted on a bearing structure, the frame being mounted on said bearing structure so that it can pivot about a horizontal axis relatively to said bearing structure.

BRIEF DESCRIPTION OF THE DRAWINGS

Other features and advantages shall appear more clearly from the following description of a preferred embodiment of the invention, given by way of an illustrative and non-exhaustive example, and from the appended drawings, of which.

DETAILED DESCRIPTION OF ILLUSTRATIVE EMBODIMENTS

As indicated here above, the principle of an embodiment of the invention lies in the fact of proposing a bead massage device in which the beads (submerged in a bath) are driven directly by the internal wall of the vessel, this vessel being mounted rotationally and preferably being easily dismounted in order to be cleaned and, if necessary, disinfected.

Figure 1:
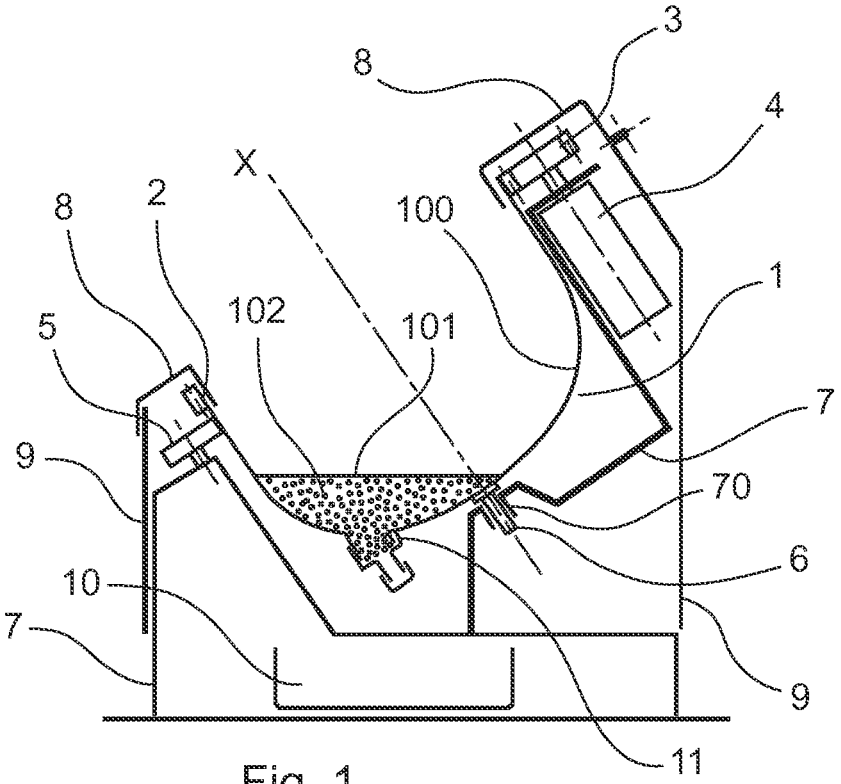
FIG. 1 is a schematic sectional view of a bead massage device according to an embodiment of the invention.

Referring to FIG. 1, a bead massage device comprises a vessel 1 having an internal wall 100 demarcating a volume destined to receive a plurality of beads 102 and a bath 101 in a quantity that is sufficiently great for the beads to be submerged in the bath.

The beads are made out of a material belonging to the following group:

steel, stainless or not;
glass;
ceramic;
high density polymer (for example HDPE)

According to an advantageous embodiment, beads made of silver or coated with silver leaf or containing silver could be added (this silver leaf being capable, when the beads are submerged, of releasing silver ions which have an advantageous disinfectant capacity in the context of an embodiment of the invention).

It must be noted that the beads present in a bead massaging device can be made out different materials present.

The beads may furthermore be round or have an ovoid shape. The dimensions of the beads are planned in such a way that each bead is contained in a sphere with a diameter ranging from 2 to 10 mm.

According to the principle of an embodiment of the invention, the vessel 1 of the device is mounted so as to be rotationally mobile.

According to the present embodiment, the vessel 1 is mounted so as to be rotationally mobile on a frame 7, the bottom of the vessel 1 having an pin 6 at its center that extends coaxially with the rotation axis X of the vessel, the frame 7 for its part having a recess 70 designed to receive the pin 6, the cylindrical recess 70 having an internal diameter sized so as to form a bearing to guide the pin 6 rotationally.

As illustrated in FIG. 1, the vessel 1 is mounted so as to be rotationally mobile about an axis X inclined between the vertical and the horizontal. The inclination of the axis X can vary as a function of the applications (hands, elbows, feet, knees etc) and will generally be such that the axis X forms an angle of 5° to 85° with the vertical.

Figure 3:
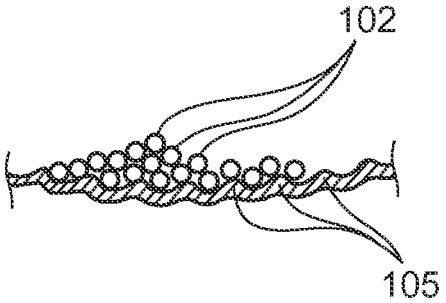
FIG. 3 is a schematic view in a partial section of the internal wall of a vessel of a bead massage device according an embodiment of to the invention.

Besides, referring to FIG. 3, the internal wall 100 has a plurality of evenly distributed ridges 105 (FIG. 3), constituting a series of relief features such as to favor the driving of the beads by the internal wall of the vessel.

Naturally, other means to favor the driving of the beads on the internal wall of the vessel can be envisaged without departing from the framework of the invention.

Figure 2:
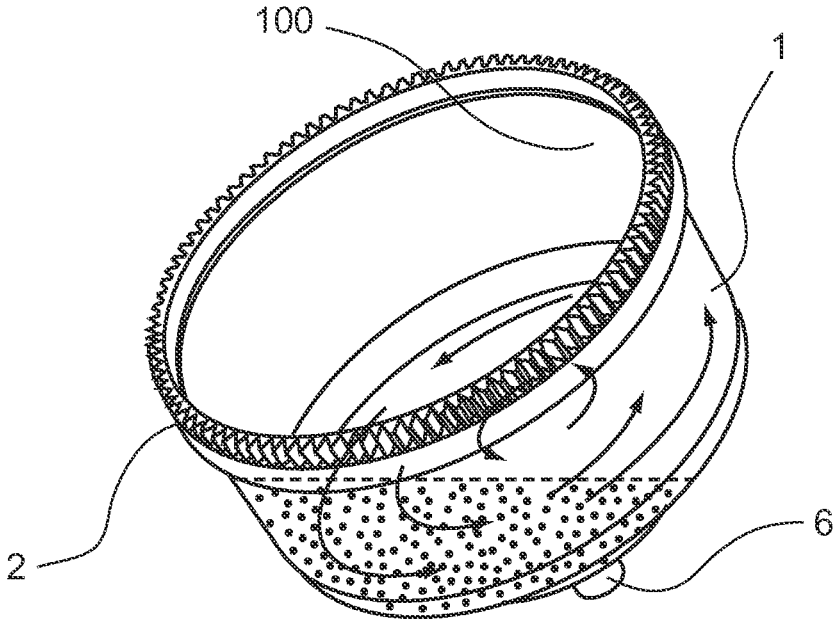
FIG. 2 is a view in perspective of a vessel of a bead massage device according to an embodiment of the invention.

The movement of the beads 102 within the vessel when the vessel is driven rotationally is illustrated in FIG. 2.

As can be seen in this figure, the inclined position of the rotational axis of the vessel, between the horizontal and the vertical, tends to give rise to a stirring of the beads which can be divided into several phases: the beads present in the bath are driven by the internal wall of the vessel, in the sense of rotation of the vessel, in a rising flow, until they reach a level where they fall back towards the central region of the vessel, and then toward the bottom of the bath in which the beads are submerged at rest.

Naturally, when a person's limb is placed in the vessel, the stifling of the beads takes place around the limb with a plurality of beads coming successively into contact with the limb and thus carrying out the massaging of the limb.

Referring to FIG. 1, a description is now provided of a massage device according to an embodiment of the invention as a whole.

As illustrated in FIG. 1, the device comprises:

the vessel 1 described here above;

a frame 7 on which the vessel 1 is mounted rotationally;

a geared motor 4 fixed to a wall of the frame 7, this geared motor having a drive pinion 3 designed to engage with a toothed ring 2 mounted on the external wall of the vessel (the toothed ring 2 can be seen more precisely in FIG. 2), the toothed ring being fixedly joined to the external wall, preferably directly in the neighborhood of the edge of the vessel demarcating the opening of the vessel;

at least one roller and preferably four rollers mounted so as to be rotationally free on the frame in such a way as to be in contact with the external wall of the vessel and guide the vessel rotationally;

a housing 9 fixed to the frame 7 designed and sized so as to prevent any risk of involuntary access to the moving parts of the device (except of course for access into the vessel);

an upper cap 8 blocking the access to the space between the vessel and the housing.

The upper cap is mounted removably on the housing.

Furthermore, the vessel 1 is mounted removably on the frame. Indeed, when the cap is absent, the vessel is not retained axially by any means on the frame 7: the vessel is placed in such a way that its pin 6 gets housed in the cylindrical recess 70 of the frame, the pin 6 sliding freely in the cylindrical recess 70 of the frame. At the same time, the vessel is positioned in such a way that the toothed ring 2 gets engaged with the drive pinion of the geared motor, the external wall of the vessel being in contact with the rollers 5.

Thus, when the cap is removed from the frame, easy access is obtained to the vessel and the exerting of traction force on the vessel along the axis X is sufficient to withdraw the vessel from the frame.

According to another advantageous characteristic of an embodiment of the invention, the device comprises at least one drain for the extraction, from the vessel, of firstly the bath in which the beads are submerged and secondly the beads.

To this end, the bottom of the vessel 1 is provided with a drainpipe 11; this drainage orifice is the one and only means of draining through which the bath and the beads can be extracted from the vessel.

Furthermore, the drainpipe is fitted out with means explained here below, used to successively extract the bath (only the beads being retained in the vessel) and then the beads.

According to the present embodiment, the draining means comprise two plugs:

a first plug 104 for draining the bath, allowing the bath to flow out of the vessel when it is withdrawn;

a second drain plug 103, provided with a retainer for retaining the beads, allowing the bath to flow out of the vessel and retaining the beads within the vessel when it is positioned on the drainpipe 11 while the first plug 104 is withdrawn from the device and enables the beads to be removed from the vessel by gravity, when it is withdrawn from the drainpipe.

Figure 4:
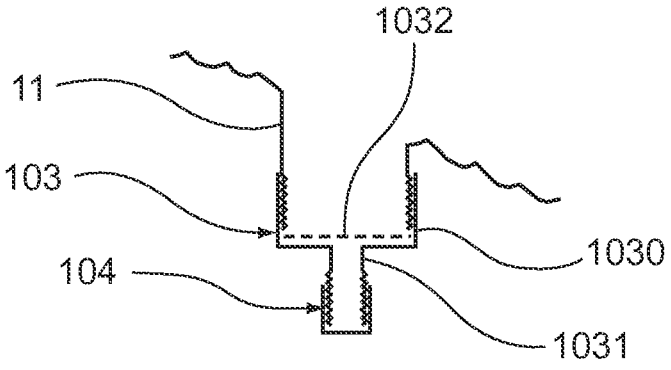
FIG. 4 is a schematic representation of a system for draining a bead massage device according to an embodiment of the invention.

Referring to FIG. 4, the second plug 103 is mounted directly, for example by being screwed onto the drainpipe 11, and includes:

a ring 1030 having, on its upper part, means for mounting it on the drainpipe 11, such as a thread on its upper part;

an extension 1031 of the ring, in the form of a coaxial conduit with the ring and having a diameter smaller than that of the ring;

a screen 1032 for holding back the beads placed within the ring, between the upper part of the ring and the extension 1031 (preferably supported on the bottom of the ring) so as to cover the conduit 1031.

Naturally, the screen 1032 has meshes whose dimensions are planned according to the diameter of the beads in order to prevent these beads from passing through the meshes of the screen.

The extension 1031 has mounting means, such as a thread, designed to work with complementary mounting means such as a thread, provided on the first plug 104 in such a way that the first plug can be mounted on the extension 1031 in order to obstruct it.

In this assembly, the first plug is therefore mounted indirectly on the drainpipe since the first plug is mounted on the second plug which for its part is mounted on the drainpipe.

The vessel is thus drained in two stages:

a first stage in which the first plug 104 is withdrawn from the device, allowing the bath to flow out of the vessel while the beads are retained by the screen 1032;

a second stage in which the second plug 103 is withdrawn from the pipe in order to extract the beads by gravity from the vessel.

A draining tub 10 (or several such tubs) are fitted into the device to receive the bath and/or the beads.

Figure 5:
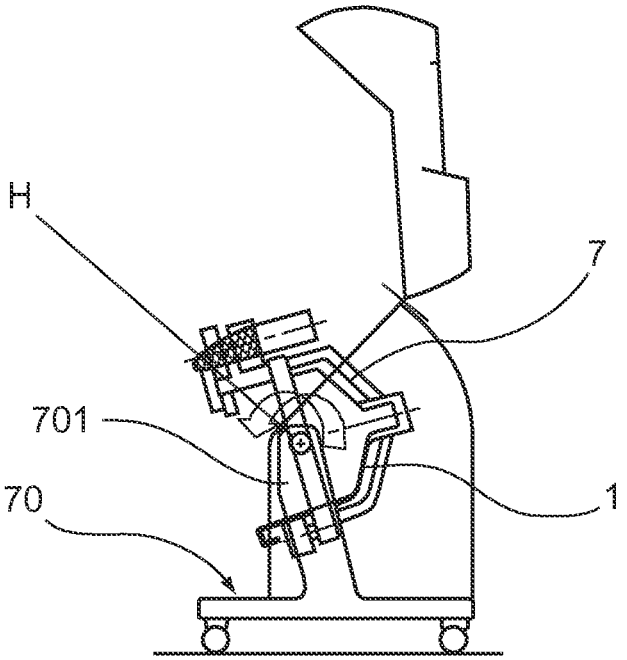
FIG. 5 is a schematic representation of an alternative embodiment of the invention.

According to one particular embodiment illustrated in FIG. 5, the vessel 1 is mounted so as to be rotationally mobile on a frame 7 which is itself mounted on a bearing structure 70. The frame is mounted on the bearing structure so that it can pivot about a horizontal axis H relatively to the bearing structure. To this end the bearing structure has two vertical members 701 each coupled to a frame by a pivot link about the axis H. Thus, the frame and therefore the vessel can be made to pivot about the axis H, thus enabling very easy access into the vessel and enabling it to be drained very speedily. Naturally means (not shown) are provided to block the pivoting of the frame relatively to the bearing structure.

A bead massage device according to an embodiment of the invention is designed to be powered by a classic 220V electrical power supply. The electrical geared motor is associated with a control and command device used to activate the rotation of the vessel and adjust the rotation speed of this vessel within a range varying from 10 rpm to 50 rpm.

The massage device according to an embodiment of the invention is preferably equipped with means for setting the height of the vessel, enabling the height of the vessel to be adapted to use and making it easier for the user to gain access to the vessel (with a different heights for massaging lower limbs and upper limbs).

An embodiment of the invention proposes a bead massage device that can be easily and swiftly dismantled and reassembled, cleaned and disinfected.

An embodiment of the invention provides a massage device of this kind that is easy to maintain.

An embodiment of the invention provides a massage device of this kind that provides for easy and swift draining of the bath in which the beads are submerged.

An embodiment of the invention provides a massage device of this kind which enables easy draining of the beads from the vessel in order to clean them, disinfect them and/or replace them.

Although the present disclosure has been described with reference to one or more examples, workers skilled in the art will recognize that changes may be made in form and detail without departing from the scope of the disclosure and/or the appended claims.

The invention claimed is:

1. A bead massage device comprising:

an open-ended vessel comprising an internal wall and being configured to receive a plurality of beads submerged in a bath, said vessel being mounted so as to be rotationally mobile; and means for driving said beads during rotation of the vessel such that the beads perform a massage when moved into contact with a person's limb inserted into said vessel, wherein said driving means comprise a series of relief features provided on the internal wall of the vessel against which said beads contact during rotation of the vessel.

2. The bead massage device according to claim 1, wherein said vessel is mounted so as to be rotationally mobile about an axis inclined between vertical and the horizontal.

3. The bead massage device according to claim 2, wherein said vessel is mounted so as to be rotationally mobile about an inclined axis forming an angle of 5° to 85° with the vertical.

4. The bead massage device according to claim 1, wherein said relief features comprise evenly distributed ridges.

5. The bead massage device according to claim 1, wherein the bead message device comprises means for draining at least one of said beads or said bath from a bottom of said vessel.

6. The bead massage device according to claim 5, wherein said means for draining comprise a first drain plug for said bath and a second drain plug for the beads, provided with means to retain said beads in said vessel.

7. The bead massage device according to claim 6, wherein said first and second plugs are mounted on a single drainpipe.

8. The bead massage device according to claim 7, wherein said second plug is mounted directly on said drainpipe, said first plug being mounted indirectly on said pipe while being coupled to the second plug which has:

a. a ring with an upper part comprising means for being mounted on said drainpipe, b. an extension of said ring at its lower part, having means for mounting said first plug; and c. a screen, which forms said means to retain said beads and retains said beads between said upper part and said extension.

9. The bead massage device according to claim 1, wherein said vessel is mounted removably on a frame bearing means for driving the vessel rotationally.

10. The bead massage device according to claim 1, wherein said vessel is mounted so as to be rotationally mobile on a frame which is itself mounted on a bearing structure, the frame being mounted on said bearing structure so that it can pivot about a horizontal axis relative to said bearing structure.

11. A bead massage device comprising:

an open-ended vessel comprising an internal wall and being configured to receive a plurality of beads submerged in a bath, said vessel being mounted so as to be rotationally mobile; and a series of relief features on the internal wall, which are configured to contact and drive said beads during rotation of the vessel such that the beads are moved by rotation of the vessel and perform a massage when brought into contact with a person's limb inserted into said vessel.

* * * * *